United States Patent [19]

Aderneck

[11] Patent Number: 4,537,235

[45] Date of Patent: Aug. 27, 1985

[54] WOOD SPLITTER

[75] Inventor: Stephen E. Aderneck, Box 188, Quathiaski Cove BC, Canada, V0P 1N0

[73] Assignee: Stephen Aderneck

[21] Appl. No.: 581,555

[22] Filed: Feb. 21, 1984

[51] Int. Cl.[3] ..... B27L 7/00

[52] U.S. Cl. ..... 144/193 C; 144/193 D; 30/308.1

[58] Field of Search ..... 144/193 R, 193 A, 193 B, 144/193 C, 193 D, 193 E, 193 F, 193 G, 193 H, 193 J, 193 K; 145/2 R

[56] References Cited

U.S. PATENT DOCUMENTS

| | | | |
|---|---|---|---|
| 4,355,671 | 10/1982 | Senior, III | 144/193 C |
| 4,372,360 | 2/1983 | Eichlin | 144/193 C |
| 4,429,727 | 2/1984 | Wilson | 144/193 R |

*Primary Examiner*—W. D. Bray
*Assistant Examiner*—Jorji M. Griffin

[57] ABSTRACT

The invention is a tool which is used for splitting sections of wood into smaller pieces. In this invention a handle is secured to a wedge-shaped metal piece having a ridge on one side, and to this piece a second driving metal piece is fastened in such a manner that it is allowed to travel slightly on a shaft extending from the first wedge-shaped metal piece, and as its center of gravity is off-centered from the center line of the wedge-shaped piece it causes a twisting or prying motion to be applied to the wood being split. Between the two metal pieces a rubber washer is secured, to temporarily absorb the energy produced by the downward force of the driving metal piece, and then to immediately release said energy into the wedge-shaped piece of metal.

1 Claim, 4 Drawing Figures

WOOD SPLITTER

BACKGROUND OF THE INVENTION (1) Field of the Invention

This invention relates to a tool for splitting sections of wood into pieces, as for firewood or like purposes.

(2) Brief Description of the Prior Art

REFERENCE: U.S. Pat. No. 4,044,609.

Other wood splitting devices have been invented and built.

In one typical tool of this sort, a plain wedge shaped metal piece is fastened to a handle, which may be wood. While simple devices of this sort work, they have certain drawbacks. The first drawback is a tendency for the device to stick in the wood, if a clean split does not occur. The second disadvantage is that due to the simple nature of the design, numerous attempts are needed to split the wood. The third disadvantage is that much shock from the impact of the metal wedge with the wood is transmitted back to the hands of the operator, resulting in increased fatigue and possible injury.

In another tool of this sort, small pivoting levers are incorporated in the wedge shaped metal piece. Such pivoting levers aid in splitting the wood, by applying a spreading force upon contact with the wood. A disadvantage to this device is that it contains numerous small pieces and is difficult to construct. Another disadvantage is that much of the shock from the impact of the metal wedge with the wood is transmitted back to the hands of the operator, resulting in increased fatigue and possible injury.

SUMMARY OF THE INVENTION

The wood splitter of my invention is comprised of:

- a wedge-shaped metal piece with a shaft threaded at its end and provision for installing a handle.
- a handle of any suitable material, installed in the wedge-shaped metal piece.
- a threaded nut.
- a metal driving piece secured indirectly to the wedge-shaped piece of metal by way of the partially threaded shaft and threaded nut.
- a shock absorbing, energy transmitting pliable rubber washer placed between the wedge-shaped metal piece and the driving metal piece.

DETAILED DESCRIPTION OF THE EMBODIMENTS OF THE INVENTION

Figure 2:
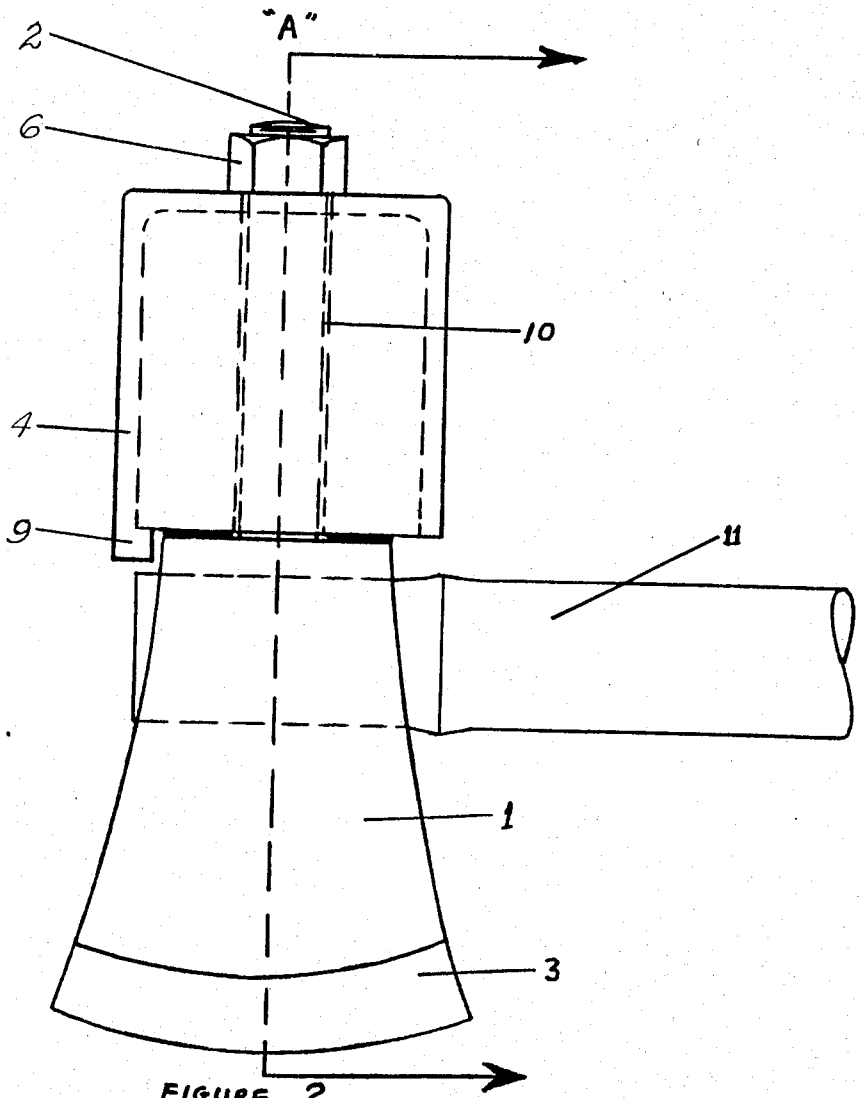
FIG. 2 is a side view of the invention
Figure 1:
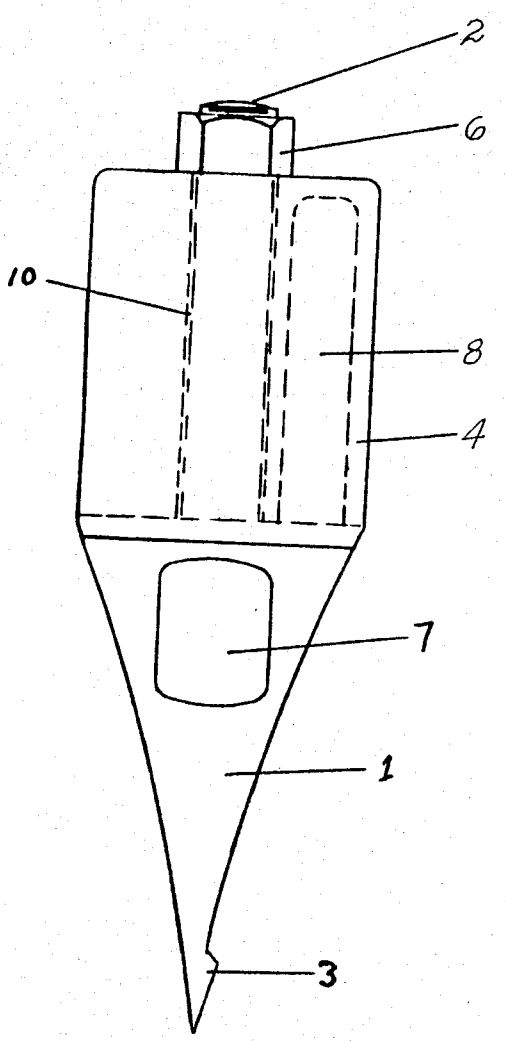
FIG. 1 is a plan view of the invention
Figure 3:
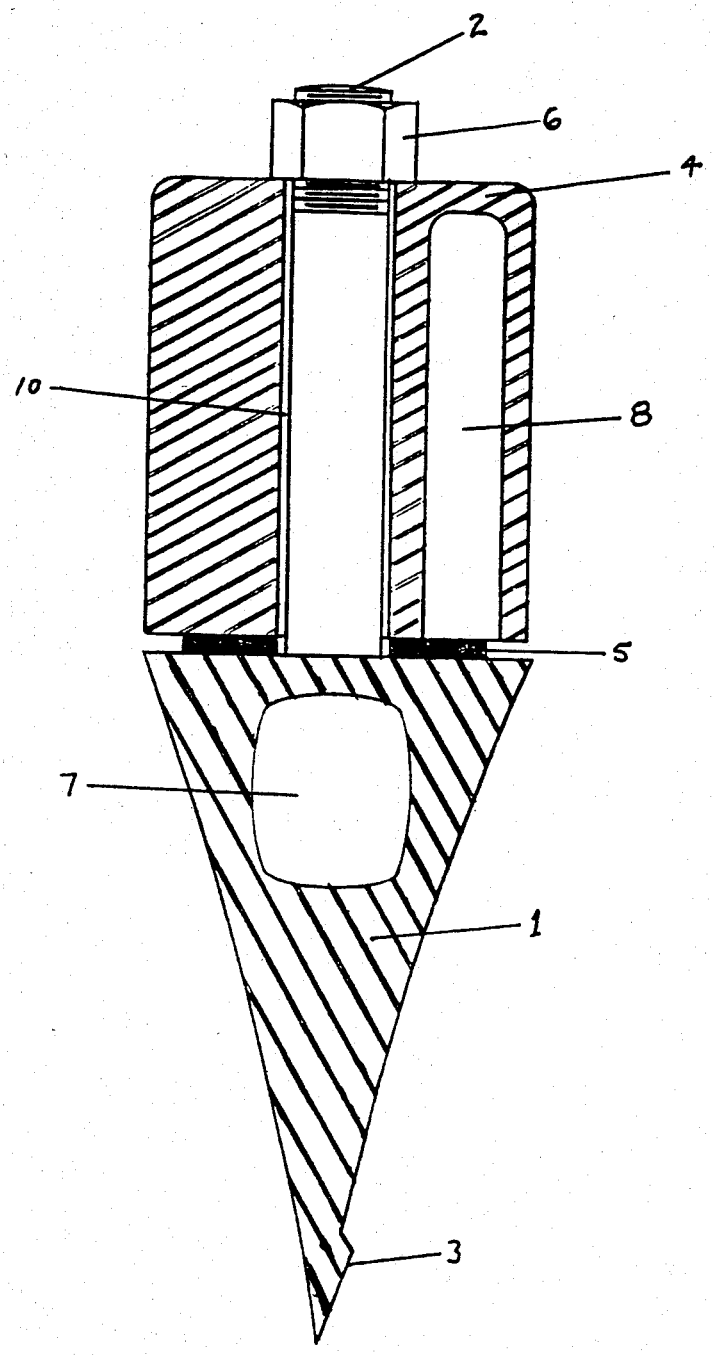
FIG. 3 is a sectional view of line "A" in FIG. 2
Figure 4:
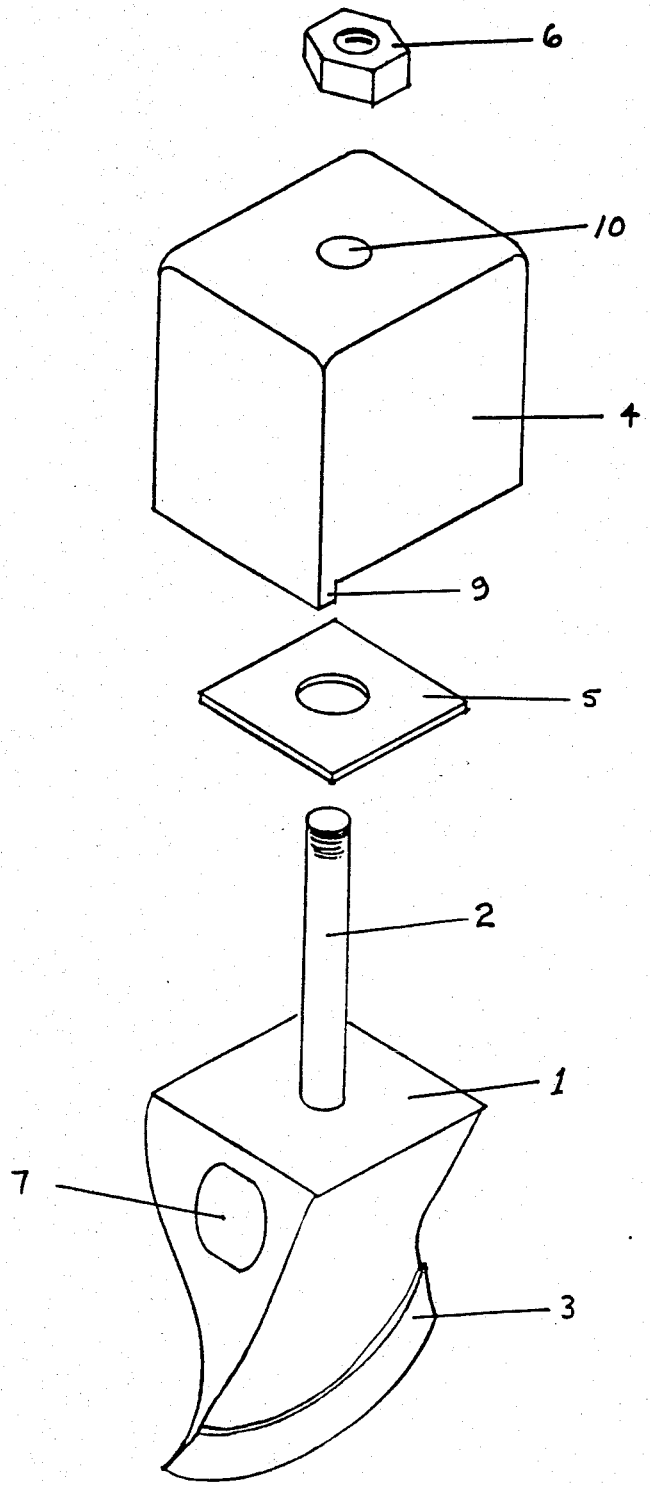
FIG. 4 is an exploded view of the invention

The invention comprises a wedge-shaped metal piece 1, containing a ridge 3, a handle hole 7, and a shaft 2, which has threads at it's end. Driving metal piece 4, contains hollow cavity 8, lip 9, and hole 10. Rubber washer 5 is installed between wedge-shaped metal piece 1 and driving metal piece 4. Nut 6 essentially secures driving piece 4 to wedge-shaped metal piece 1, by threading onto shaft 2. Metal driving piece 4 is prevented from turning on wedge-shaped metal piece 1, by lip 9. Handle 11 is secured to wedge-shaped metal piece 1, in hole 7.

OPERATION OF THE WOOD SPLITTER

A section of wood is placed on end on a firm flat surface.

The invention is lifted overhead and swung at the piece of wood, in such a manner that the lower sharpened end of wedge-shaped metal piece 1 is caused to strike the section of wood.

As contact is made with the section of wood, and as wedge-shaped metal piece 1 begins to split the section of wood, resistance to the movement of wedge-shaped metal piece 1 is encountered. This causes driving metal piece 4, which still contains momentum and kinetic energy to travel downwards on shaft 2, compressing rubber washer 5.

When rubber washer 5 is compressed to the extent possible dependent on the force of the downward swing, metal driving piece 4 ceases it's downward travel on shaft 2. At this moment, part of the energy of the swing is contained by way of compressive forces temporarily stored in the rubber washer 5.

After maximum compression of the rubber washer 5 has occured, there is an immediate expansion force generated by the rubber washer 5. As metal driving piece is heavier than metal wedge-shaped piece 1, and has more inertial mass, the expansionary force of the rubber washer 5 tends to be transmitted to the lighter wedge-shaped metal piece 1, causing a further downward motion of this piece into the section of wood.

While the above described compressive action and subsequent expansion and release of temporarily stored energy is occurring, another independent action is simultaneously occurring.

This additional action is initiated by ridge 3, on wedge-shaped metal piece 1. Ridge 3 on one side of wedge-shaped metal piece 1 causes entire device to swing in the opposite direction. As the center of gravity of the device is well above said ridge 3, a powerful prying action occurs as the top of the device swings in an arc, with the center of said arc being the exteme tip of wedge-shaped metal piece 1.

This prying action is accentuated further by virtue of the fact that the metal driving piece 4 is not evenly balanced, as it has a hollow chamber 8 on the same side as ridge 3. The off-centered mass of the metal driving piece 4 tends to cause the entire device to pivot strongly in the same direction as that initiated by ridge 3, as described above. The result is an additional prying action applied to the section of wood.

All of the above described actions combine to produce a very effective splitting action.

In addition, another benefit of this invention is reduced operator fatigue. Less shock is transmitted back to the operators hands, due to the increased length of time of action of this device, compared to ordinary wood splitters.

Those skilled in the art will realize that variations to the invention can be made without departing from the scope or spirit of the invention. For example, variations in the sizes or shapes or relative weights of the pieces could be used and various fastening provisions could be made for a handle. Other changes could also be made.

What is claimed is:

1. A wood splitting tool comprising a wedge-shaped metal piece having a thickened end portion and an opposite, elongated, wood penetrating blade portion having opposite sides; said tool further comprising a ridge along one side of said blade portion, a handle tool located in said end portion for securing a handle therein, a shaft attached to and extending outwardly from said end portion opposite said blade portion and having threads at its free end, a driving piece having a central hole therethrough for slideably engaging said threaded shaft, and a nut threadably attached to said shaft for securing said driving piece to said shaft; said driving piece being of greater mass than said wedge-shaped piece and having a means defining a hollow cavity and a means defining a lip for preventing rotation of said driving piece with respect to said wedge-shaped piece; said tool also having a rubber washer located between said wedge-shaped piece and said driving piece.

* * * * *